United States Patent [19]

Brown et al.

[11] 4,129,210

[45] Dec. 12, 1978

[54] DOLL DISPLAY RECEPTACLE

[76] Inventors: David A. Brown, 1611 31st St., NW., Washington, D.C. 20007; E. A. Carmean, Jr., 3308 Legation St., NW., Washington, D.C. 20015

[21] Appl. No.: 805,541

[22] Filed: Jun. 10, 1977

[51] Int. Cl.[2] ..... B65D 5/44; B65D 25/54

[52] U.S. Cl. ..... 206/45.31

[58] Field of Search ..... 206/45.31, 45.34, 45.14, 206/45.19; 229/15

[56] References Cited

U.S. PATENT DOCUMENTS

| | | | |
|---|---|---|---|
| 2,058,648 | 10/1936 | Wellman | 206/45.31 |
| 2,451,806 | 10/1948 | Carson | 206/45.31 |
| 2,748,928 | 6/1956 | Stavis et al. | 229/15 |
| 2,921,673 | 1/1960 | Ryan | 206/45.31 |
| 3,730,335 | 5/1973 | Tarrson | 206/45.31 |

*Primary Examiner*—William T. Dixson, Jr.
*Attorney, Agent, or Firm*—Edwin E. Greigg

[57] ABSTRACT

A receptacle for containing and displaying a toy doll including a folded blank box, a front panel of which is provided with a framed window, the sill of which extends rearwardly and has a cutout portion within which a doll may be retained and displayed against an interior backdrop panel contained within the box.

3 Claims, 4 Drawing Figures

DOLL DISPLAY RECEPTACLE

BACKGROUND OF THE INVENTION

A large variety of folding blank box types have been developed and are known in the art for containing toy dolls. Some of those which are known in the art include a means for displaying the doll contained therein. Such box displays include those which have a window or other aperture for viewing the merchandise which is desired to be displayed. These box displays typically and disadvantageously require the use of a separate interliner within the box, provided with a retaining means of cardboard, rubber band, string or other fastener, for retaining the doll in a positive fashion on the interliner within the container, so that the doll is viewable and is not injured by potential violent movement of the container in shipping and handling. The instant invention overcomes these disadvantages without the use of a separate interliner to hold the doll, resulting in an inexpensive containerizing medium by which the doll can be quickly and simply packaged for sale and yet visibly merchandised.

OBJECTS AND SUMMARY OF THE INVENTION

A principle object of the invention is to provide a folded blank box in a single unit which can be assembled to retain the doll and display it simultaneously.

A further object of the invention is to provide a unitary receptacle which can be quickly and easily assembled as a box for a doll.

A still further object of the invention is to provide a box or receptacle with means to display the doll in an environment uniquely related to the doll, namely, as a three dimensional representation of a two dimensional work of art in order to convey the specific connotations or meanings of the work of art in a different medium.

The invention comprises a folded blank box with top, bottom and side walls and front and rear panels, the front panel of which has a window cut out and a contiguous frame surrounding it. The window has a lower sill portion extending into a flap notched at its transverse extremity, which when folded at right angles to the front panel forms a retaining means for the trunk of the doll. Another embodiment of the invention allows for a second window with a movable flap, so that the lower extremities of the doll may be viewed. In addition, the invention comprehends the use of an insert behind the doll to provide a backdrop or background scene to further enhance the display environment for merchandising.

DESCRIPTION OF THE PREFERRED EMBODIMENT

Figure 1:
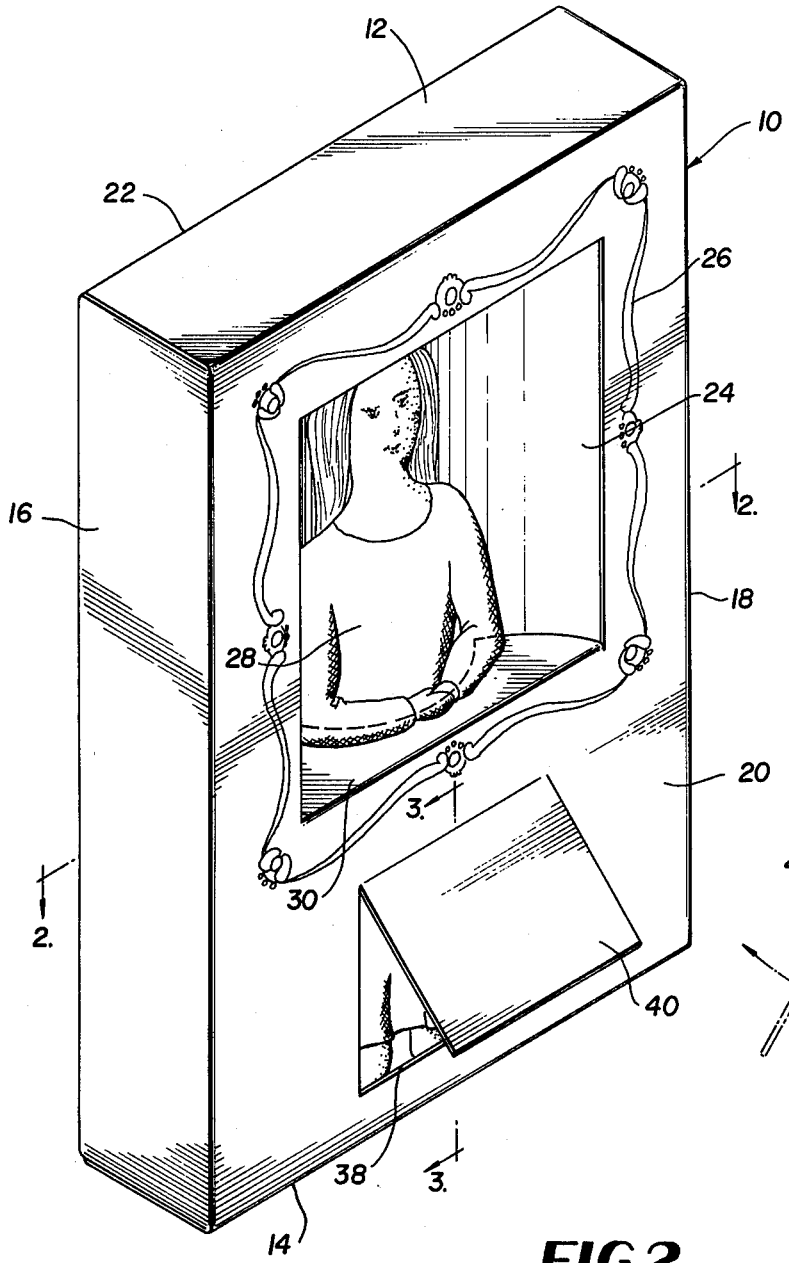
FIG. 1 is a perspective view of the box according to the invention.
Figure 3:
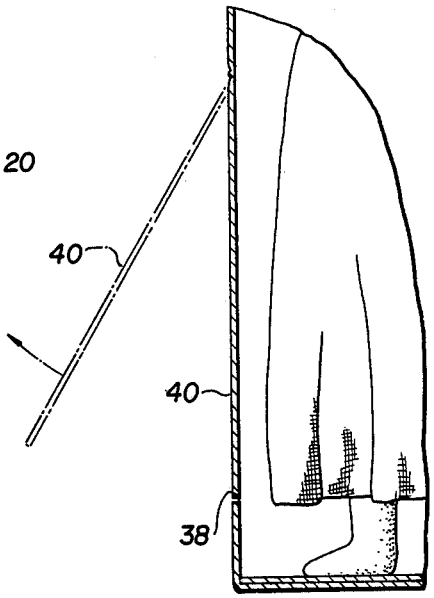
FIG. 3 is a partial cross sectional view taken along line 3—3 of FIG. 1, illustrating the lower movable flap.
Figure 2:
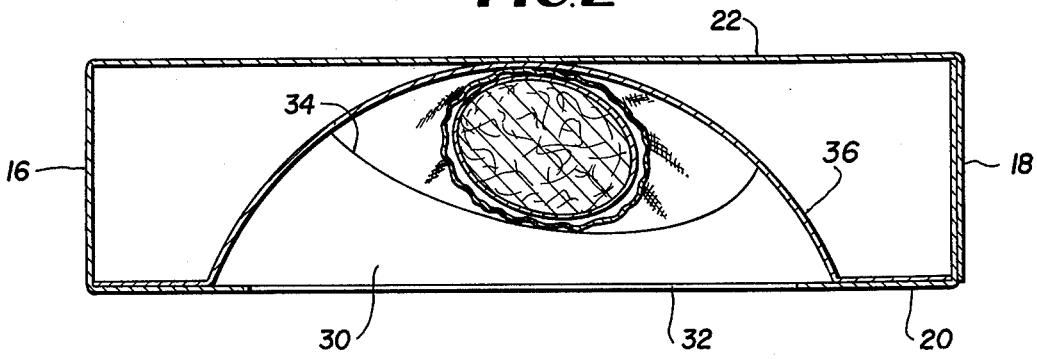
FIG. 2 is a cross sectional view of the box, taken along the line 2—2 of FIG. 1 showing details of the sill flap as a doll retaining device.
Figure 4:
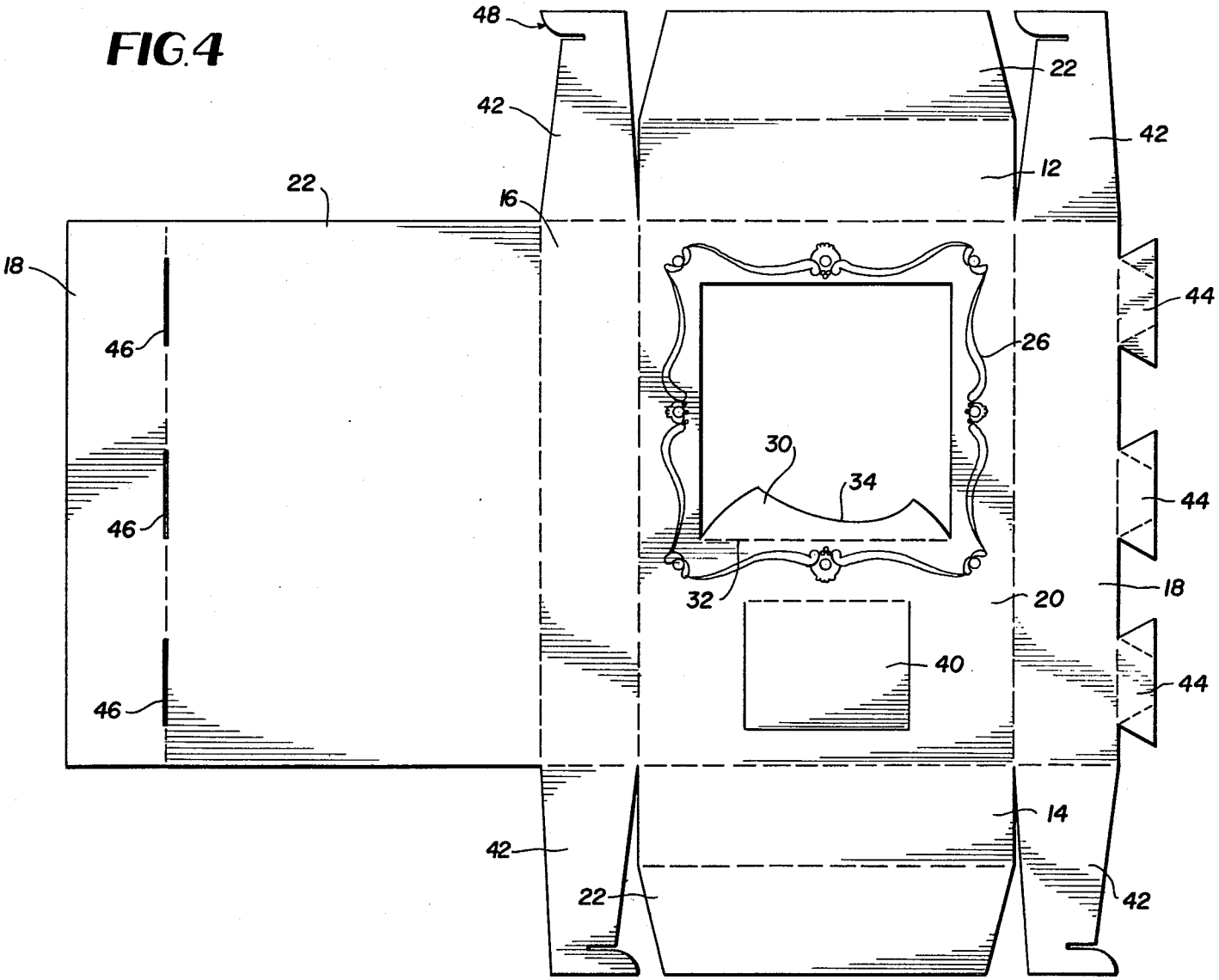
FIG. 4 is a plan view of the blank used to construct the box of FIGS. 1–3.

A box or display receptacle, according to FIGS. 1–3 of the invention, comprises a folded blank box, 10, having interlocking top 12, bottom 14, and side walls 16, 18, and front and rear panels 20, 22, respectively. In the upper portion of the front panel there is provided a cut-out window 24, and a contiguous frame 26, surrounding the window. This frame may be printed, embossed, molded or otherwise applied to the front panel in a known manner. Within the receptacle there can be placed a doll 28, only the trunk portion of which can be viewed through the window. The doll is held in place and retained for display purposes by means of a flap 30, which extends inwardly from a fold line 32 to form a window sill (FIGS. 1 and 2). In the transverse extremity of the flap 30 there is provided a notched edge 34, as best seen in FIGS. 2 and 4, of a shape complemental to the trunk portion of the doll 28.

When the doll is inserted into the box, the flap 30 is folded back at right angles to the front panel 20, so that the edge 34 comes into contact with the trunk of the doll, which is thereby positively retained against movement due to its engagement with the edge 34 and the panel 22.

In another embodiment of the invention, an interior backdrop panel 36 may be placed behind the doll, with printed or otherwise applied scenery thereon to enhance the visual environment against which the doll is displayed.

As noted above in the third stated object, the invention provides an environment uniquely related to the doll. For example, in the case of a Mona Lisa doll, the edge 34 defines an irregular curve (FIG. 4) which is purposely shaped so that when the doll is inserted into the box it will assume the orientation depicted in the actual painting. Also, the flap 30 serves as a support for the doll's arms and hands, again for the purpose of conforming the doll's appearance to the actual painting. In this case too, the panel 36 would be preferrably utilized and would depict the background in the actual painting.

The invention also comprehends another feature, which may be an optional provision in the front panel. A second window 38, as best seen in FIGS. 1 and 3, may be provided in the lower area of the front panel 20 with a movable flap 40 to permit selective viewing of the lower extremities of the doll 28. In this fashion a prospective purchaser may be apprised that the doll is a full-length doll, and not merely a bust or torso aligned with the window and frame.

The box or receptacle 10 is assembled from the blank shown in FIG. 4. For this purpose the tabs 42, 44 and the slots 46 are provided. The tabs 42 have interlocking ends 48, while the tabs 44 are passed through the slots 46. The actual retention of these tabs is conventional and need not be further discussed.

From the foregoing description it can be seen that the three stated objects of the invention are achieved. The box 10 is easily assembled from the blank shown in FIG. 4, and includes means for retaining the doll 28 for display, and if desired, to retain the doll for display in a particular orientation and in an environment uniquely related to the doll.

What is claimed is:

1. In combination, a doll and a display receptacle within which the doll is retained and supported for shipment and display, the receptacle comprising, a folded blank box having interlocking top, bottom, side walls and front and rear panels, said front panel including a cut out portion serving as a window with a surrounding frame in the upper area thereof for display of the trunk portion of the doll within the box, and an integrally formed flap having a free end defining a notched edge, said flap extending into the box through the cut out portion at substantially right angles to the front panel with the notched edge in engagement with the doll for retaining the doll within the box in engagement with at least the rear panel and in a spatial orientation relative to the box panels so that the front part of the displayed trunk portion of the doll faces a plane which intersects the plane of the front panel.

2. The combination as defined by claim 1, further comprising an interior panel, affixed to the interior of said box behind said cut out portion for providing a background scene viewable through said window.

3. The combination as defined by claim 2, wherein the box further has a second window defined by a moveable flap in said front panel below said cut out portion for selective viewing of the interior of said box, thereby disclosing lower portions of the body of said doll.

* * * * *